US009211742B2

(12) United States Patent
Yokozawa

(10) Patent No.: US 9,211,742 B2
(45) Date of Patent: Dec. 15, 2015

(54) IMAGE FORMING APPARATUS, IMAGE FORMING METHOD, AND RECORDING MEDIUM STORING AN IMAGE FORMING PROGRAM

(71) Applicant: Suguru Yokozawa, Kanagawa (JP)

(72) Inventor: Suguru Yokozawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/079,066

(22) Filed: Nov. 13, 2013

(65) Prior Publication Data

US 2014/0146103 A1 May 29, 2014

(30) Foreign Application Priority Data

Nov. 29, 2012 (JP) ..... 2012-261219

(51) Int. Cl.
*B41J 11/00* (2006.01)
*B41J 19/20* (2006.01)

(52) U.S. Cl.
CPC ..... *B41J 19/205* (2013.01)

(58) Field of Classification Search
CPC ..... B41J 11/00; B41J 11/008; B41J 2/0458; B41J 2/04563; B41J 29/393; B41J 2/04591; B41J 2/04581
See application file for complete search history.

(56) References Cited

U.S. PATENT DOCUMENTS

| | | | | |
|---|---|---|---|---|
| 7,726,766 | B2 * | 6/2010 | Ishikawa | 347/19 |
| 2005/0001876 | A1 * | 1/2005 | Kato | 347/37 |
| 2006/0024109 | A1 | 2/2006 | Morikawa et al. | |
| 2009/0237744 | A1 * | 9/2009 | Ogura et al. | 358/448 |
| 2011/0141181 | A1 * | 6/2011 | Ito et al. | 347/16 |
| 2011/0205271 | A1 | 8/2011 | Sai | |

FOREIGN PATENT DOCUMENTS

| | | | |
|---|---|---|---|
| CN | 1727200 | A | 2/2006 |
| CN | 101547796 | A | 9/2009 |
| JP | 6-286276 | | 10/1994 |
| JP | 2003118094 | A | 4/2003 |
| JP | 2003-200570 | | 7/2003 |
| JP | 2004-025549 | | 1/2004 |
| JP | 2004174984 | A | 6/2004 |
| JP | 2006-015562 | | 1/2006 |

(Continued)

OTHER PUBLICATIONS

Foreign translation to English of JP 2004-025549.*

(Continued)

*Primary Examiner* — Alessandro Amari
*Assistant Examiner* — Jeremy Delozier
(74) *Attorney, Agent, or Firm* — Harness, Dickey & Pierce

(57) ABSTRACT

An image forming apparatus can detect a foreign object promptly during homing operation. After starting the homing operation, the image forming apparatus determines whether or not a carriage stops moving by detecting motion or stop of the carriage until timing to change detecting when either the carriage reaches predetermined position or velocity of the carriage reaches predetermined value. If the image forming apparatus determines that the carriage stops moving, the image forming apparatus controls a main scanning motor to stop driving. After the timing to change detecting, the image forming apparatus detects load variation of the main scanning motor. If the load variation is detected, the image forming apparatus controls the main scanning motor to stop driving.

19 Claims, 13 Drawing Sheets

(56) References Cited

FOREIGN PATENT DOCUMENTS

| | | | |
|---|---|---|---|
| JP | 2011126045 | A | 6/2011 |
| JP | 2012060830 | A | 3/2012 |

OTHER PUBLICATIONS

Office Action for corresponding Chinese Application No. 201310587197.7 dated Mar. 23, 2015.

* cited by examiner

| PWM COMMAND VALUE | CONVERTED VOLTAGE | DUTY RATIO |
|---|---|---|
| 4000 | +24V | +100% |
| 2000 | 0V | 50% |
| 0 | −24V | 0% |

IMAGE FORMING APPARATUS, IMAGE FORMING METHOD, AND RECORDING MEDIUM STORING AN IMAGE FORMING PROGRAM

CROSS-REFERENCE TO RELATED APPLICATION

This patent application is based on and claims priority pursuant to 35 U.S.C. §119 to Japanese Patent Application No. 2012-261219, filed on Nov. 29, 2012 in the Japan Patent Office, the entire disclosure of which is hereby incorporated by reference herein.

BACKGROUND

1. Technical Field

The present invention relates to an image forming apparatus, image forming method, and recording medium storing an image forming program.

2. Background Art

Conventionally, as an example of image forming apparatuses such as a printer, a facsimile, a copier, a plotter, and a multifunctional peripheral (MFP), an inkjet recording apparatus that adopts a liquid ejection recording method using a recording head comprised of a liquid ejecting head (droplet ejecting head) that ejects droplets is well known.

In a serial-type inkjet recording apparatus, which forms an image mounting a recording head on a carriage that moves reciprocally back and forth over a sheet of recording media, it is necessary to determine the home position of the carriage for proper printing. For this reason, a technology that uses a position where the carriage strikes a side plate of the apparatus as the home position or as a reference point for determining the home position (i.e., homing operation) has been proposed (e.g., JP-2003-200570-A).

In addition, if the recording medium floats during recording or a foreign object accidently touches the carriage while the carriage is moving, it is necessary to detect same and stop the carriage promptly. Accordingly, a technology that acquires information on position and velocity of the carriage using a linear encoder while calculating velocity driving command values and feeding back the calculated values to determine driving status of the carriage from the difference between input carriage and actual position and velocity of the carriage, and stopping the carriage in case the difference exceeds an allowable value, has been proposed (e.g., JP-2006-240026-A).

SUMMARY

Example embodiment of the present invention provides an image forming apparatus that includes a carriage that mounts a recording head and moves reciprocally back and forth, a detector that detects a position and velocity of the carriage, and a driving controller that controls a driving source of the carriage. The driving controller includes a stopping detector that detects that the carriage stops moving and a load variation detector that detects load variation of the driving source. The driving controller uses either the stopping detector or the load variation detector in accordance with the position or velocity of the carriage. The driving controller controls the driving source depending on detection results obtained by the stopping detector until the carriage reaches predetermined position or velocity of the carriage reaches a predetermined value. The driving controller controls the driving source depending on detection results obtained by the load variation detector after the carriage reaches a predetermined position or velocity of the carriage reaches a predetermined value.

Example embodiments of the present invention include a driving controlling method executed by the image forming apparatus, and a non-transitory recording medium storing a program that causes the computer to implement the driving controlling method.

BRIEF DESCRIPTION OF THE DRAWINGS

A more complete appreciation of the disclosure and many of the attendant advantages thereof will be readily obtained as the same becomes better understood by reference to the following detailed description when considered in conjunction with the accompanying drawings.

DETAILED DESCRIPTION

Figure 1:
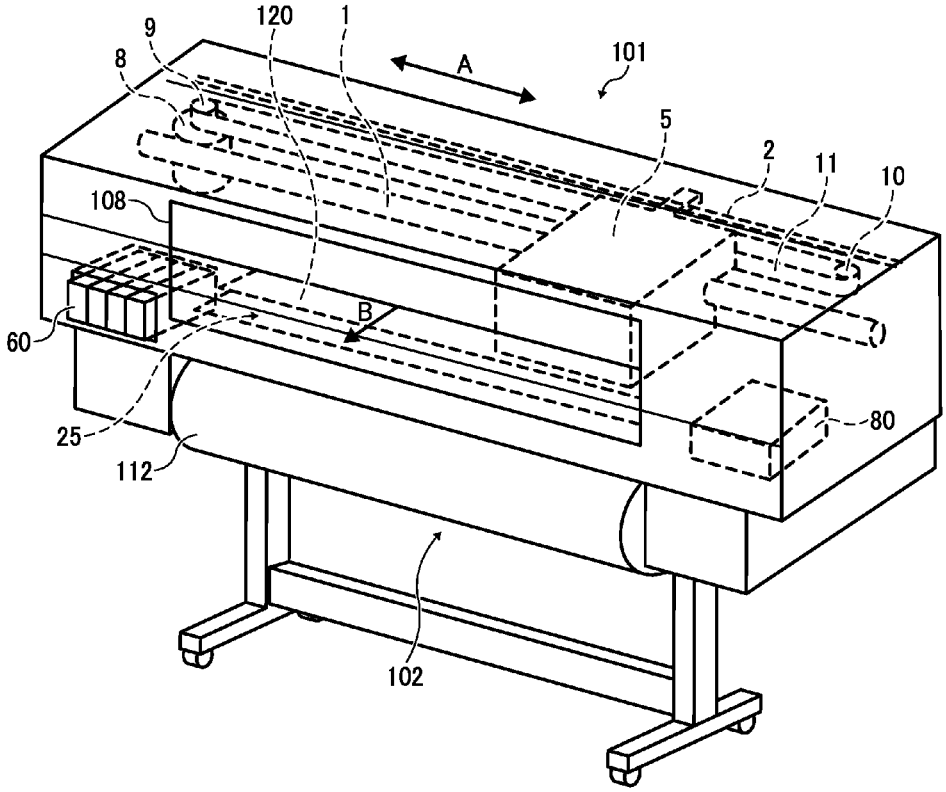
FIG. 1 is a perspective diagram illustrating an image forming apparatus as an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

The inventor of the present invention has discovered that, in the background image forming apparatus, when the homing operation described above is performed, it is determined that the carriage stops moving if a driving motor that drives the carriage is stopped (detected velocity of the carriage becomes zero) when the carriage strikes a side plate. Consequently, if the foreign object that interferes with the carriage is more elastic than the side plate during the homing operation, it is not immediately determined that the carriage stops moving, sometimes resulting in damage to the carriage.

In view of the above, in the following embodiment, an image forming apparatus is provided that stops the carriage promptly if a foreign object interferes with the carriage during the homing operation.

Figure 2:
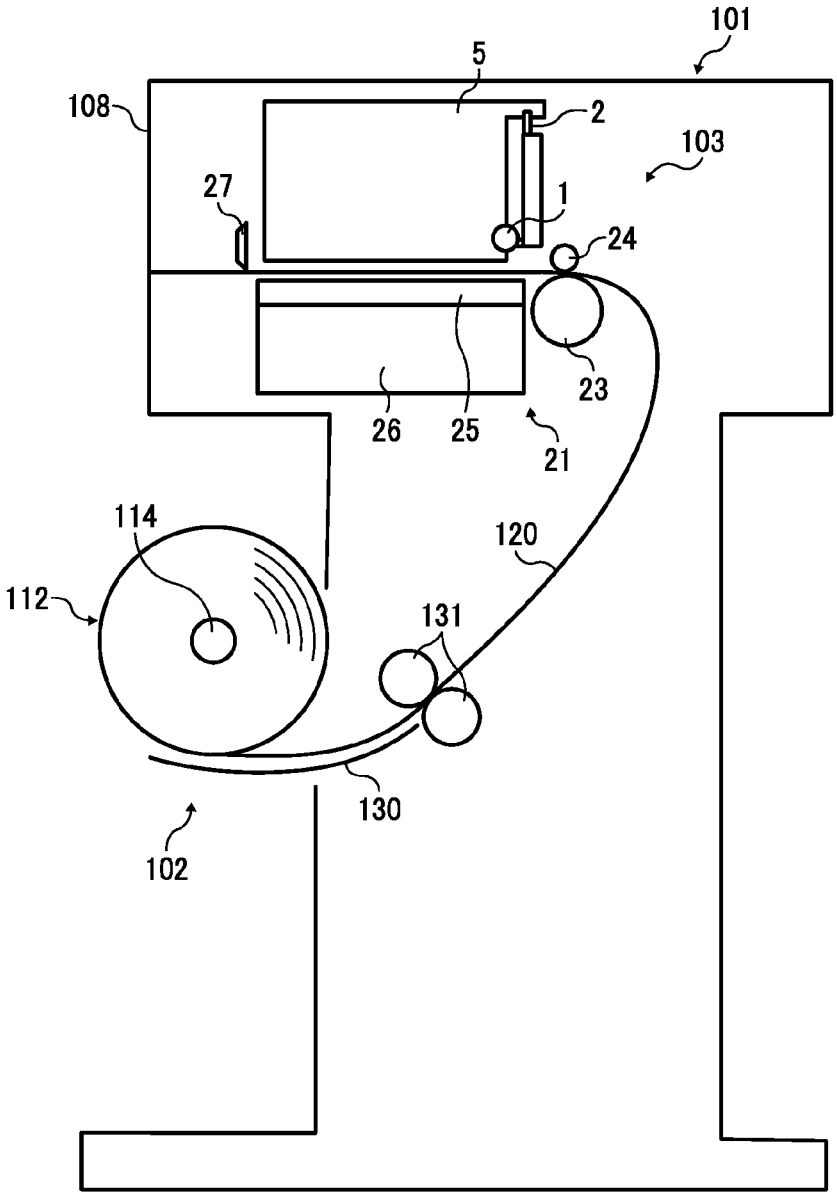
FIG. 2 is a side view illustrating the image forming apparatus as an embodiment of the present invention.
Figure 3:
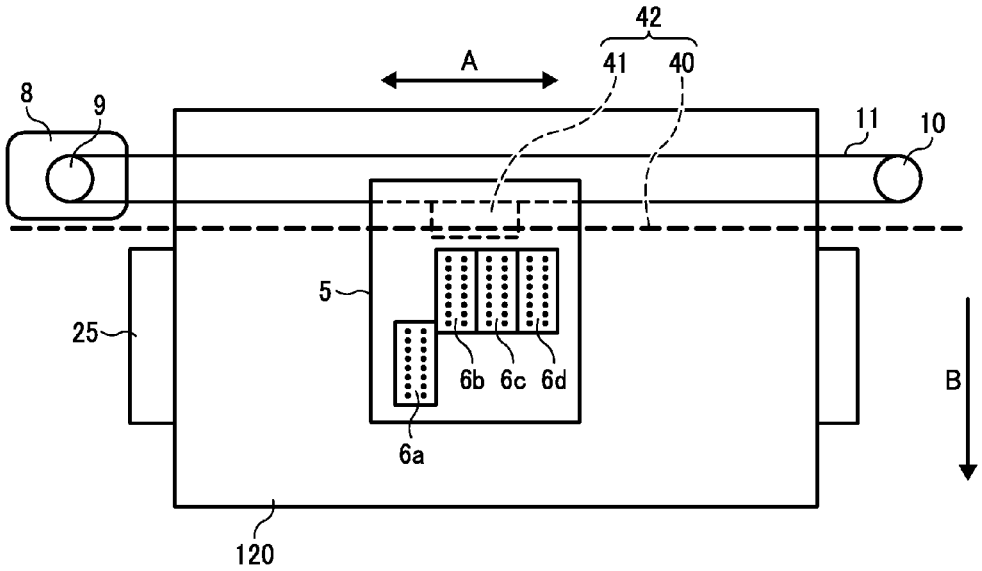
FIG. 3 is a diagram illustrating part of an image forming unit in the image forming apparatus as an embodiment of the present invention.

An example of an image forming apparatus in the present invention will be described with reference to FIG. 1, FIG. 2, and FIG. 3. FIG. 1 is a perspective diagram illustrating the image forming apparatus. FIG. 2 is a side view illustrating the image forming apparatus. FIG. 3 is a diagram illustrating part of an image forming unit in the image forming apparatus.

In the present embodiment, the image forming apparatus is a serial-type image forming apparatus and includes a main unit 101 and a sheet feeder 102 located on the underside of the main unit 101. While the sheet feeder 102 is located on the underside of the main unit 101 separately in most cases, the sheet feeder 102 is integrated with the main unit 101 as a single unit in FIG. 2.

An image forming unit 103 that forms an image on roll sheet 120 fed from the sheet feeder 102 is located in the main unit 101.

Also, an openably closable cover 108 that opens to expose the interior of the image forming unit 103 located inside in the front side of the main unit 101 (hereinafter, the side from which the roll sheet 120 is ejected after being printed and cut is referred to as the front side).

In the image forming unit 103, a guide rod 1 and guide stay 2 as guiding components are laid across side plates 51 and 52 on both sides, and a carriage 5 is held on the guide rod 1 and guide stay 2 movable in the direction of arrow A (the main scanning direction, carriage moving direction).

A main scanning motor 8 that drives the carriage 5 back and forth is located on one side of the carriage 5 in the main scanning direction. A timing belt 11 is entrained around a driving pulley 9 driven by the main scanning motor 8 and a driven pulley 10 located on the opposite side of the main scanning direction. A belt holder (not shown in figures) of the carriage 5 is fixed on the timing belt 11, and the carriage 5 is moved reciprocally back and forth in the main scanning direction by the driving of the main scanning motor 8.

The carriage 5 includes recording heads from 6*a* to 6*d* (hereinafter referred to collectively as "recording head 6") that integrate multiple (5 in this embodiment) liquid ejecting heads with a head tank that supplies liquid to the liquid ejecting head.

The recording head 6*a* is disposed offset by an amount equivalent to the length of one head (one nozzle row) in the sub-scanning direction perpendicular to the main scanning direction from the recording heads from 6*b* to 6*d*. Also, the recording head 6 lays out nozzle rows comprised of multiple nozzles that eject droplets in the sub-scanning direction perpendicular to the main scanning direction, and those nozzles are mounted so that the droplets are ejected downward.

Each of the recording heads from 6*a* to 6*d* includes two rows of nozzle. In the recording heads 6*a* and 6*b*, black droplets are ejected from each nozzle row. In the recording head 6*c*, cyan (C) droplets are ejected from one nozzle row, and the other nozzle row is unused. In the recording head 6*d*, yellow (Y) droplets are ejected from one nozzle row, and magenta (M) droplets are ejected from the other nozzle row. Consequently, in the case of a monochrome image, the image can be formed with two head widths in one scanning (main scanning) using the recording heads 6*a* and 6*b*. In the case of a color image, the image can be formed using the recording heads from 6*b* to 6*c* for example.

It is to be noted that the configuration of the head is not limited to the example described above, and alternatively all multiple recording heads can be disposed in the main scanning direction.

An ink cartridge as a main tank mounted on the main unit 101 detachably supplies each color of ink to the head tank of the recording head 6.

Also, an encoder sheet 40 is disposed along the moving direction of the carriage 5. The carriage 5 includes an encoder sensor 41 that scans the encoder sheet 40. The encoder sheet 40 and the encoder sensor 41 together form a linear encoder 42. Position and velocity of the carriage 5 is detected from output of the linear encoder 42.

In a recording area among main scanning areas of the carriage 5, the roll sheet 120 is fed by the sheet feeder 102 and carried in the direction perpendicular to the main scanning direction of the carriage 5 (sub-scanning direction, sheet feeding direction: arrow B direction) intermittently.

A sheet carrier unit 21 includes a carrier roller 23 that carries the roll sheet 120 fed by the sheet feeder 102 and a compression roller 24 disposed opposite to the carrier roller 23. A carrier guide 25 on which multiple aspiration holes are formed and an aspiration fan 26 that aspires through the aspiration holes of the carrier guide 25 are disposed in the downstream side of the carrier roller 23.

As shown in FIG. 2, a cutter 27 that cuts the roll sheet 120 on which the image is formed by the recording head 6 in predetermined lengths is disposed in the downstream side of the carrier unit 21.

Furthermore, a cleaning unit 80 that cleans and maintains the recording head 6 is located at the side of the carrier guidance on the other side in the main scanning direction of the carriage 5.

The sheet feeder 102 includes a roll unit 112. The roll unit 112 is comprised of the roll sheet 120 described above as long roll medium rolled on a core tube 114.

In this embodiment, both a unit that a trailer part of the roll sheet 120 is fixed to the tube 114 by bonding such as gluing and a unit that a trailer part of the roll sheet 120 is not fixed to the tube 114 can be mounted as the roll unit 112.

On the main unit 101, a guide 130 that guides the sheet pulled from the roll unit 112 in the sheet feeder 102 and a pair of carrier rollers 131 that bends the roll sheet 120 and carries it upwardly are disposed.

The roll sheet 120 unreeled from the roll unit 112 is carried set up between the carrier roller 131 and the roll unit 112 by driving the pair of carrier rollers 131. Subsequently, the roll sheet 120 is sent between the carrier roller 23 and the compression roller 24 of the carrier unit 21 via the pair of carrier rollers 131.

In the image forming apparatus configured as described above, the carriage 5 is moved in the main scanning direction and the roll sheet 120 supplied from the sheet feeder 102 is carried intermittently by the carrier unit 21. Subsequently, an intended image is formed on the roll sheet 120 by driving the recording head 6 and ejecting droplets in accordance with image data (print data). After forming the image, the cutter 27 cuts the roll sheet 120 to a predetermined length. Subsequently, the cut sheet is guided by an ejection guide disposed on the front side of the main unit 101 (not shown in figures), ejected in a bucket, and stored.

Figure 4:
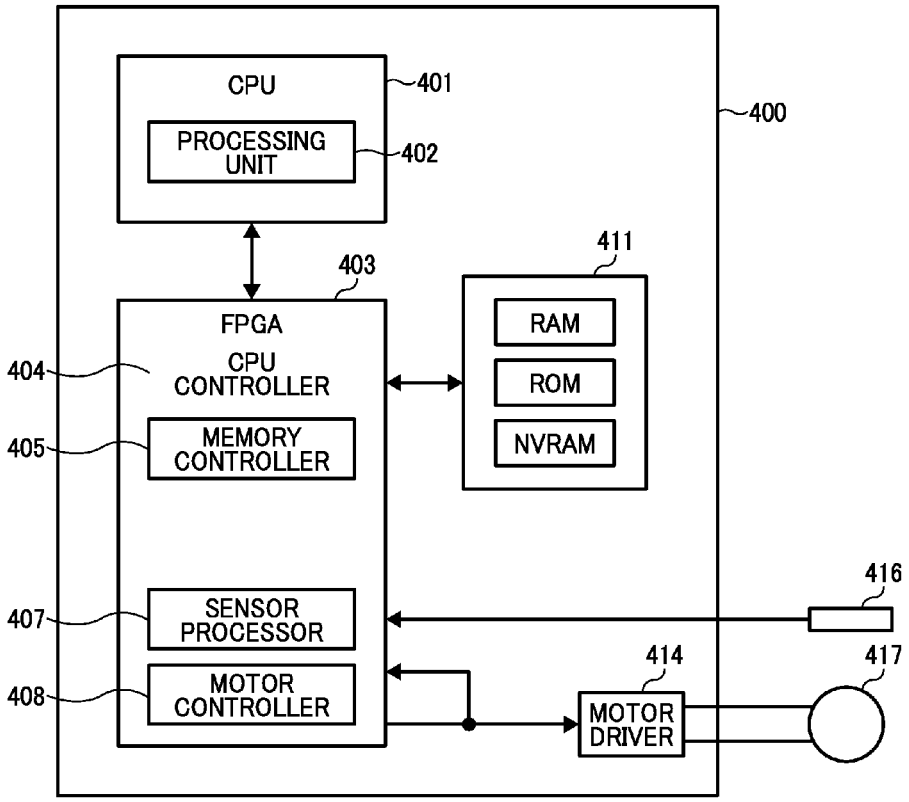
FIG. 4 is a block diagram illustrating a configuration of a controller in the image forming apparatus as an embodiment of the present invention.

FIG. 4 is a block diagram illustrating a configuration of a controller in the image forming apparatus.

The controller 400 includes a CPU 401, a Field Programmable Gate Array (FPGA) 403, a memory 411 such as a RAM, ROM, and NVRAM, and a motor driver 414.

A processing unit 402 of the CPU 401 communicates with each unit of the FPGA 403.

The FPGA 403 includes a CPU controller 404 that communicates with the CPU 401 and a memory controller 405 that accesses the memory 411.

Also, the FPGA 403 includes a sensor processor 407 that processes a sensor signal from the encoder sensor 416 etc. The sensor processor 407 includes a generator that generates a position signal and a velocity signal from an output signal of the linear encoder 42. Also, the FPGA 403 includes a motor controller 408 that controls driving the motor 417, including the main scanning motor 8.

The encoder sensor 416 includes an encoder sensor 41 for the linear encoder 42 that detects position and velocity of the carriage 5 described above and an encoder sensor that comprises a rotary encoder that detects rotational amount of the carrier roller 23.

The motor 417 includes the main scanning motor 8 described above, a sub-scanning motor that drives the carrier roller 23, and a paper feeding motor that drives the pair of carrier rollers 131. A DC motor or a stepping motor can be used for these motors.

Here, the operation of the main scanning motor 8 included in the motor 417 will be described below.

After commanding to start operation, the CPU 401 sends a command of moving velocity and moving distance to the motor controller 408. After receiving the command from the CPU 401, the motor controller 408 generates a driving profile from the information on the command for the velocity and the distance and compares it with encoder information acquired from the encoder sensor 41 included in the encoder sensor 416 via the sensor processor 407. Subsequently, the motor controller 408 calculates a PWM command value. After finishing predetermined operations, the motor controller 408 notifies the CPU 401 of finishing the operation, and the CPU 401 receives a command of finishing the operation.

Alternatively, instead of creating the driving profile by the motor controller 408, the CPU 401 can generate the driving profile and send a command to the motor controller 408. That is, the CPU 401 and the motor controller 408 comprise a driving controller that controls driving of the main scanning motor 8 that drives the carriage 5 by PWM control. In addition, the controller 400 comprises a load variation detector and a stopping detector, in this embodiment.

Figure 5:
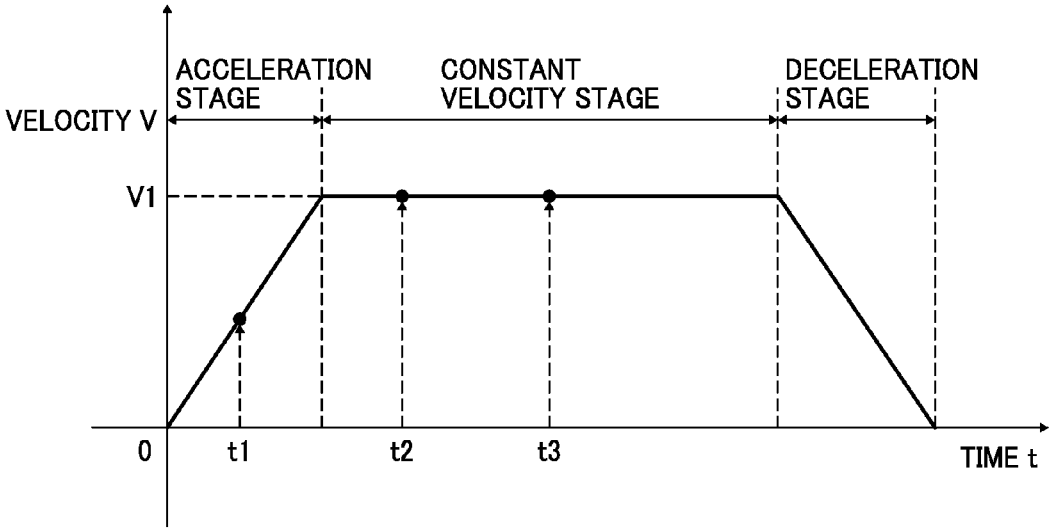
FIG. 5 is a diagram illustrating velocity control of a carriage as an embodiment of the present invention.

Next, an example of velocity control of the carriage will be described below with reference to FIG. 5. FIG. 5 is a diagram illustrating change of carriage velocity in driving the carriage.

In this embodiment, a servo system that includes PI control loop controls the driving of the main scanning motor 8 that scans the carriage 5 by PWM control. This system controls the carriage velocity by changing a command value that determines duty ratio of PWM (hereinafter referred to as "velocity command value").

The moving velocity of the carriage (carriage velocity V) is divided into an acceleration stage, a constant velocity stage, and a deceleration stage over time t. In the acceleration stage, after the carriage 5 starts moving, the carriage velocity V reaches target velocity V1. In the constant velocity stage, the carriage 5 moves at the target velocity V1. In the deceleration stage, after the carriage 5 starts decelerating from the target velocity V1, the carriage stops (its velocity becomes zero). When the carriage is moved normally such as when forming an image, the carriage 5 is moved for the commanded moving distance by accelerating in the acceleration stage, moving at a constant velocity in the constant velocity stage, or decelerating in the deceleration stage in accordance with target velocity and moving distance commanded by the CPU 401.

Next, the moving of the carriage 5 in homing operation will be described below.

During initialization, for example, after the carriage 5 is moved toward the right side panel 51, the carriage 5 strikes the side panel 51 as a struck component. Subsequently, by configuring the position where the carriage 5 strikes the side panel 51 (or position moved for predetermined distance in the reverse direction) as the home position of the carriage 5, the absolute position in the main scanning direction can be determined. Alternatively, the carriage 5 can hit the left side panel 52 as the struck component.

In performing the homing operation, the moving distance commanded by the CPU 41 is longer than a distance that adds maximum moving width of the carriage 5 to the deceleration stage. Consequently, the carriage 5 strikes the side panel (the struck component) before the carriage 5 reaches the deceleration stage.

In the homing operation, after detecting that the carriage 5 stops, driving stop control of the main scanning motor 8 (first driving stop control) is performed in the acceleration stage. Also, driving stop control of the main scanning motor 8 (second driving stop control) is performed by detecting load variation of the main scanning motor 8 in the constant velocity stage.

Here, the driving stop control by detecting stopping can be changed into the driving stop control by detecting load variation when the carriage velocity reaches the predetermined target velocity V1 by the motor controller 408 as a trigger.

In this case, depending on where the carriage 5 starts moving, the carriage 5 strikes the side panel 51 at time t1 in the acceleration stage, or the carriage 5 strikes the side panel at time t2 or t3 in the constant velocity stage as shown in FIG. 5. However, since the moving distance of the carriage 5 commanded by the CPU 41 is longer than the distance that adds maximum moving width of the carriage 5 to the deceleration stage as described above, the carriage 5 does not hit the side panel 51 in the deceleration stage.

Next, start position of the homing operation will be described with reference to FIGS. 6A, 6B, and 6C. The start position of the homing operation can be anywhere within the region where the carriage 5 can move in the main unit 101. This is because the absolute position of the carriage 5 can be unclear at the time of starting the homing operation in case the carriage 5 is moved during power-off, for example.

Here, the carriage 5 can move between the left side panel 52 (the other side in the main scanning direction) and the right side panel 51 (one side in the main scanning direction). After starting the operation, the carriage 5 moves in the direction of the arrow in FIG. 6 and strikes the right side panel. In this case, since the home position is located in the right side of the region where the carriage 5 can move around, the carriage 5 strikes the right side panel 51.

Figure 6A:
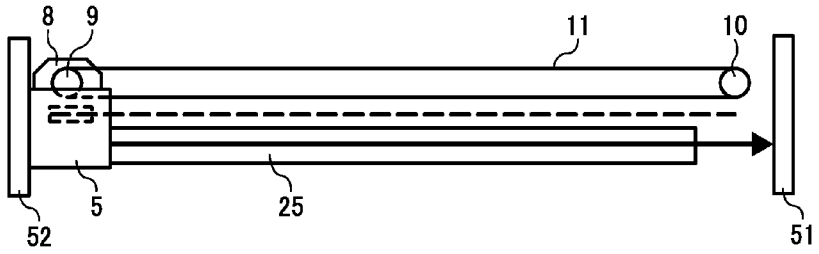
FIGS. 6A, 6B, and 6C are diagrams illustrating a start position of a homing operation as an embodiment of the present invention.

In FIG. 6A, the carriage 5 starts moving from the left end of the main scanning area (the left side panel 52). Here, as described above, the stopping of the carriage is detected in the acceleration stage, and the load variation is detected in the constant velocity stage. It should be noted that the moving distance is configured so that the carriage 5 enters the constant velocity stage even if the carriage 5 moves the maximum width. Subsequently, after detecting that the side panel 51 is struck by determining the load variation of the main scanning motor 8 in the constant velocity stage, the home position is identified.

Figure 6B:
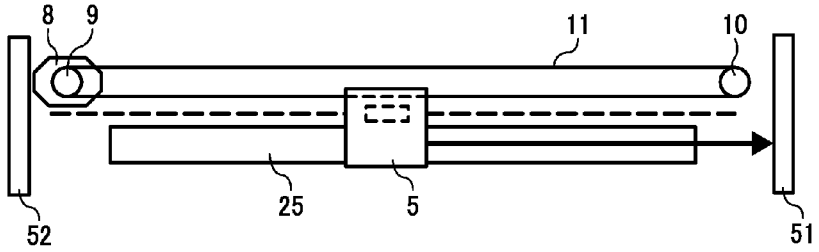

In FIG. 6B, the carriage 5 starts moving from around the center of the main scanning area. Similarly, as described above, the stopping of the carriage is detected in the acceleration stage, and the load variation is detected in the constant velocity stage.

Figure 6C:
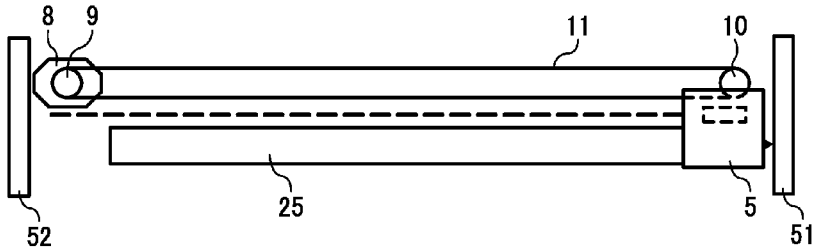

In FIG. 6C, the carriage 5 starts moving from right in front of the right side panel 51 and strikes the right side panel 51 in the acceleration stage. As described above, in the acceleration stage, it is determined that the carriage 5 strikes the right side panel 51 by determining the stopping of the carriage 5 (determining whether its velocity becomes zero or not), and the home position is identified.

As described above, in case of changing the stopping detection into the load variation detection depending on the carriage velocity, that can be performed when detection velocity of the carriage 5 detected by the encoder sensor 42 exceeds the command velocity commanded in the velocity command value.

Figure 7:
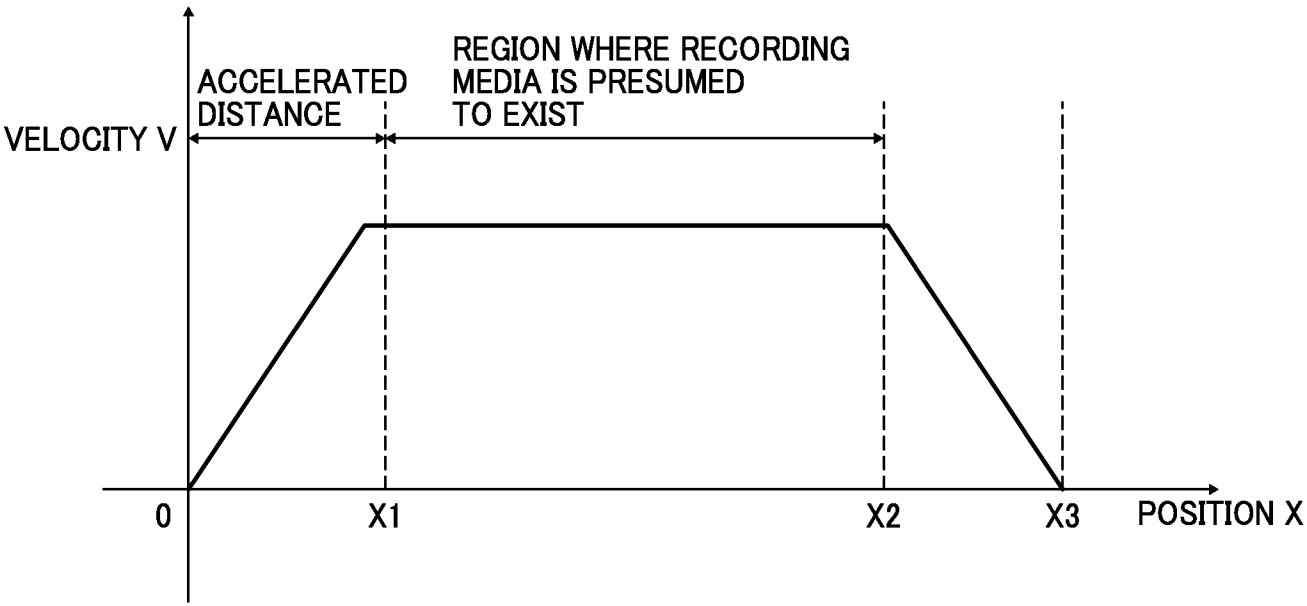
FIG. 7 is a diagram illustrating changes in velocity stages of the carriage according to distance traveled by the carriage, illustrating switching from detecting stopping to detecting load variation as an embodiment of the present invention.

Next, another example of the timing to switch from the first driving stop control to the second driving stop control with reference to FIG. 7. FIG. 7 is a diagram illustrating velocity stages of the carriage according to distance moved by the carriage.

In the above description, while the example of switching from the first driving stop control to the second driving stop control depending on the acceleration stage or the constant velocity stage of the carriage velocity is described, alternatively it is also possible to switch depending on the carriage position.

In FIG. 7, "region where recording media is presumed to exist" means the region where the motor controller 408 presumes that the recording media (the roll sheet 120) exists.

In addition, "accelerated distance" means the moving distance of the carriage 5 necessary to accelerate the carriage velocity. The carriage 5 starts moving from the position that is accelerated distance away from the edge of the recording media. For example, if it is configured that the accelerated distance is 30 mm, acceleration finish position X1 is the position where the carriage 5 moves 30 mm from the motion start position 0. In FIG. 7, the carriage velocity reaches the highest velocity (target velocity) before the position X1 (upstream side in the main scanning direction.)

For example, if the carriage 5 moves the distance configured as the accelerated distance, the first driving stop control (detecting stopping of the carriage 5) is performed until the acceleration finish position X1 where the region where the recording media is presumed to exist, and the second driving stop control (detecting load variation of the main scanning motor 8) is performed afterward to determine whether or not the carriage 5 strikes the side panel 51.

Since it is highly possible that the carriage 5 touches the recording media within the region where the recording media is presumed to exist, it is determined whether or not the carriage 5 strikes the side panel 51 within that region only by detecting the load variation of the main scanning motor 8.

It should be noted that the homing operation is performed so that the deceleration start position X2 and the target stop position X3 are not generated.

In addition, it is possible to switch from the first driving stop control to the second driving stop control at an image forming starting position where the recording head 6 starts ejecting droplets and forming an image on the recording medium.

Figure 8:
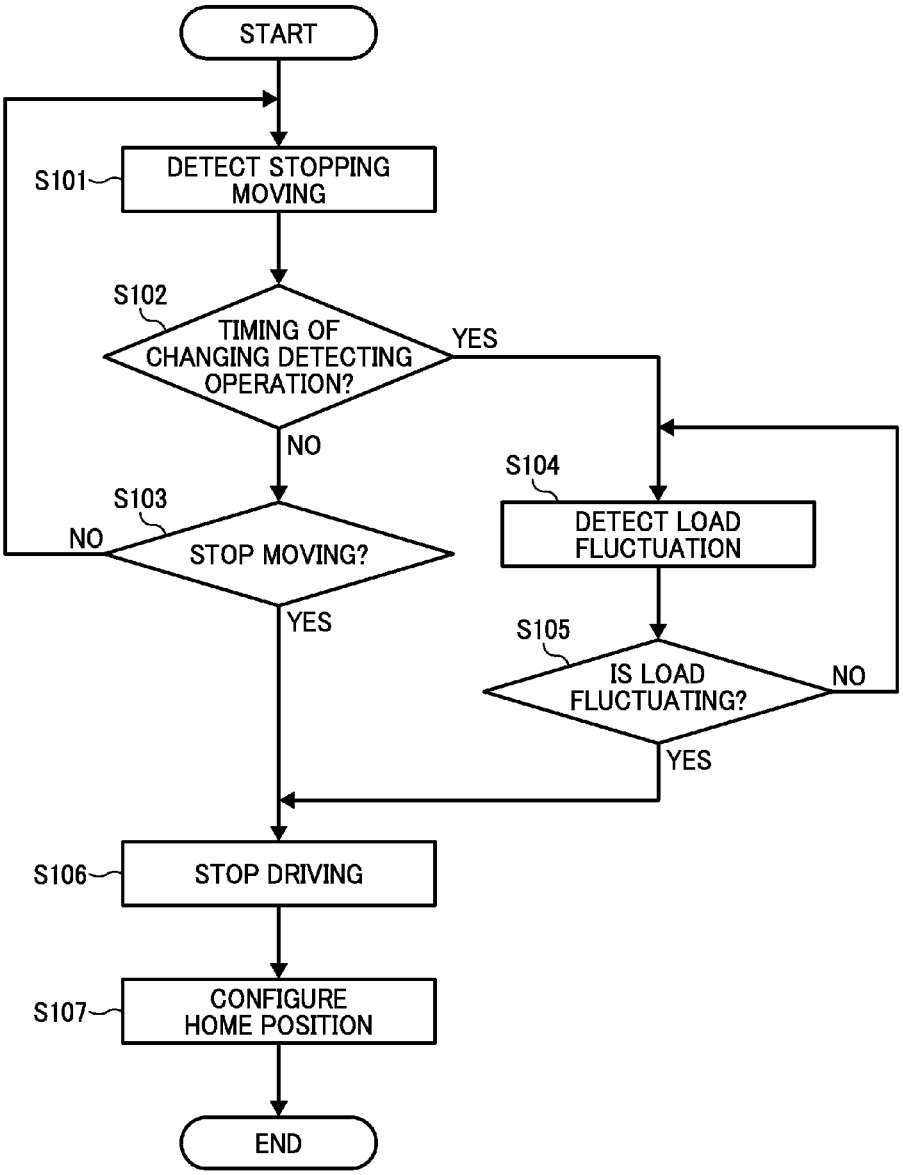
FIG. 8 is a flowchart illustrating a carriage control process (for a main scanning motor) at the time of homing operation by the controller as an embodiment of the present invention.

Next, an example of controlling driving of the carriage (main scanning motor) by the controller in the homing operation will be described with reference to FIG. 8.

After starting the homing operation, the motor controller 408 in the controller 400 detects stopping of the carriage 5 in S101. Subsequently, the motor controller 408 determines whether or not it is the timing to switch the detecting operation in S102. If the motor controller 408 determines that it is not the time to switch, the motor controller 408 determines whether or not the carriage 5 stops moving in S103. If the carriage 5 does not stop moving, the process returns to S101.

Alternatively, if the carriage 5 stops moving, the motor controller 408 stops driving the main scanning motor 8 in S106. The motor controller 408 stops driving the main scanning motor 8 by setting a command to stop the motor to the PWM command value. Also, the motor controller 408 can stop driving the main scanning motor 8 by cutting off driver output of the motor driver 414.

Alternatively, if the timing to switch detection comes during determining whether or not it is detected that the carriage 5 stops moving, the process proceeds to S104 to detect the load variation of the main scanning motor 8.

In performing the load variation detecting process, the motor controller 408 determines whether or not the load variation of the main scanning motor 8 is detected in S105. If the load variation is detected, the motor controller 408 stops driving the main scanning motor 8 in S106.

Afterward, next time to stop driving the main scanning motor 8 in S106, the home position of the carriage 5 is configured in S107, and the homing operation ends.

In this case, the timing to switch the detecting operation can be determined by checking whether or not the carriage velocity reaches the target velocity V1 as described above. Alternatively, the timing can be determined by checking whether or not the carriage position reaches the load variation detecting region (e.g., the carriage reaches the acceleration finish position X1).

It can be determined that the main scanning motor 8 stops moving when the input value from the encoder sensor 41 does not change for a certain period of time. Alternatively, it can be determined that the main scanning motor 8 stops moving when the moving velocity (detected velocity) of the carriage 5 calculated from the input value from the encoder sensor 41 remains at zero for a certain period of time. In this case, the stopping detector detects that the moving velocity of the carriage 5 remains at zero for a certain period of time.

The load variation is detected by comparing motor output values to the main scanning motor 8 (voltage value or current value) multiple times while the carriage 5 moves at a constant velocity with motor output value at the corresponding timing when the carriage 5 moves in the same direction last time. Subsequently, after comparing the difference between the motor output values with a predetermined threshold value, if the difference exceeds the threshold value, it is determined that the carriage 5 touches a foreign object (including the side panel 51) and the load variation changed.

The home position setting is to configure the position where it is detected that the carriage 5 strikes the side panel 51 (struck component) as "zero" and reset a counter to measure the position of the carriage 5 (determining, updating, and checking the absolute position).

Figure 9:
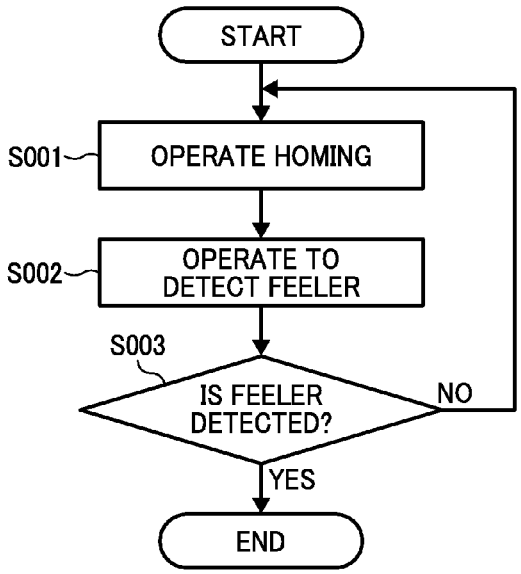
FIG. 9 is a flowchart illustrating a post-homing operation control process as an embodiment of the present invention.

Next, a first example of controlling after the homing operation will be described below with reference to FIG. 9.

In the homing operation described above, the position where the carriage 5 intervenes with a foreign object and stops driving by detecting the load variation before the carriage 5 strikes the side panel 51 is also configured as the home position. To solve this issue, it is checked whether or not the configured home position is correct.

First, as a prerequisite, in the image forming apparatus, the head tank of the recording head 6 in the carriage 5 includes a displacement component (displaceable component) that generates displacement in accordance with remaining amount of inside liquid (hereinafter referred to as "feeler"), and the main unit includes a main body detector that detects the feeler (hereinafter referred to as "main unit sensor") (not shown in figures).

After performing the homing operation in S001, it is performed detecting the feeler in S002, and it is determined whether or not the feeler is detected in S003.

If the feeler is not detected, it is determined that the home position configured by the homing operation is not correct, and the homing operation is performed again.

Alternatively, if the feeler is detected, it is determined that the home position configured by the homing operation is correct, and the process ends.

Here, after moving the carriage 5 to the position of the main unit sensor, the feeler is detected by scanning the feeler by the main unit sensor. Consequently, it is possible to detect whether or not the absolute position of the carriage 5 is misaligned.

The feeler described above is used for detecting the remaining amount of ink in the head tank and has detecting range for a certain amount of width, so it is not used for detecting the home position. However, since the feeler itself cannot be detected if the home position is misaligned, it still can be used for determining whether or not the home position is correct.

It should be noted that the detector that detects the feeler described above can also be installed as a detector that detects any misalignment of the home position.

Figure 10:
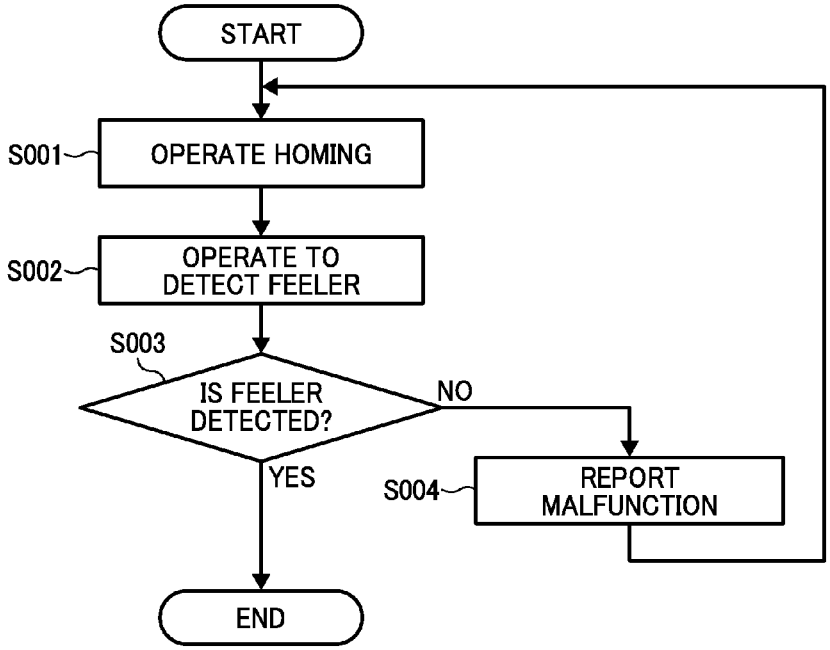
FIG. 10 is a flowchart illustrating another post-homing operation control process as an embodiment of the present invention.

Next, a second example of controlling after the homing operation will be described below with reference to FIG. 10. In the second example, if the feeler is not detected even after trying to detect the feeler in the first example described above, the homing operation is performed again after reporting a malfunction in S004.

Figure 11:
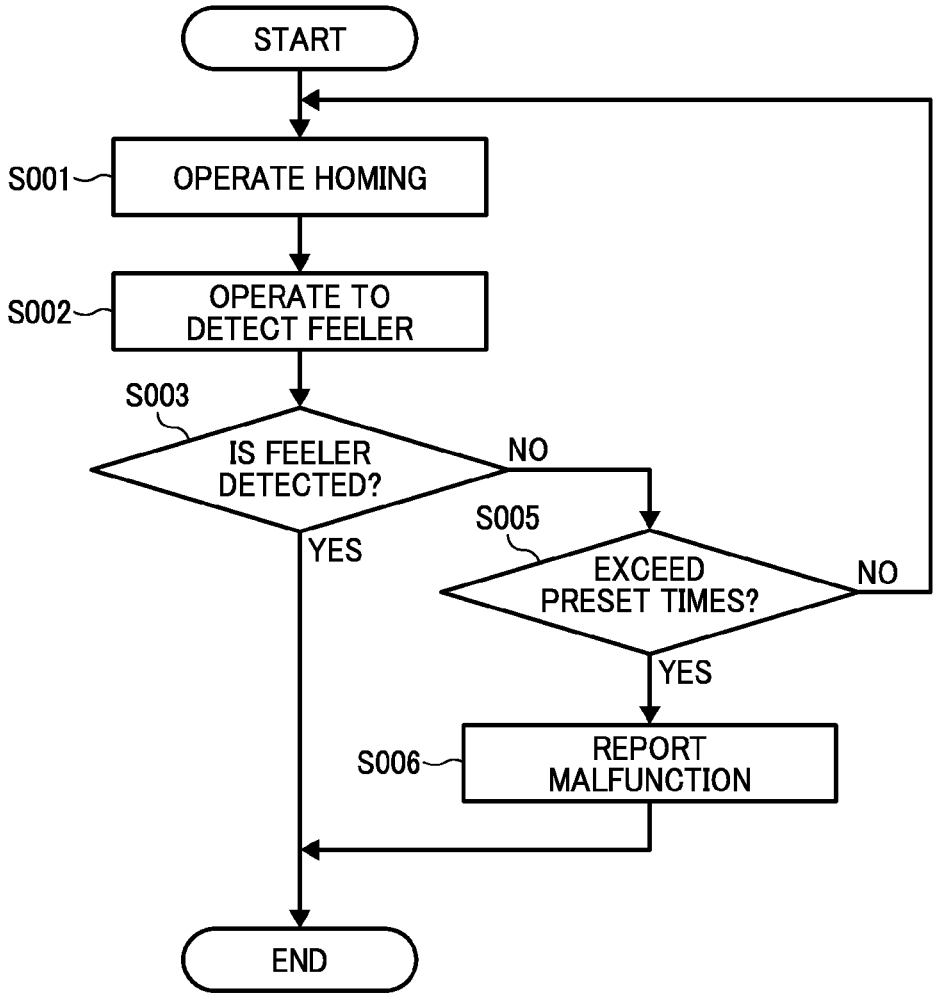
FIG. 11 is a flowchart illustrating yet another post-homing operation control process as an embodiment of the present invention.

Next, a third example of controlling after the homing operation will be described below with reference to FIG. 11. In the third example, it is determined whether or not the number of times that the feeler is not detected even after trying to detect the feeler in the first example described above exceeds a preset value in S005. Subsequently, the homing operation is performed again until exceeding the preset value. In case of exceeding the preset value, irregular operation is reported in S006, and the process ends. Consequently, a scenario in which the configuration of the home position never ends can be avoided.

Figures 12, 13:
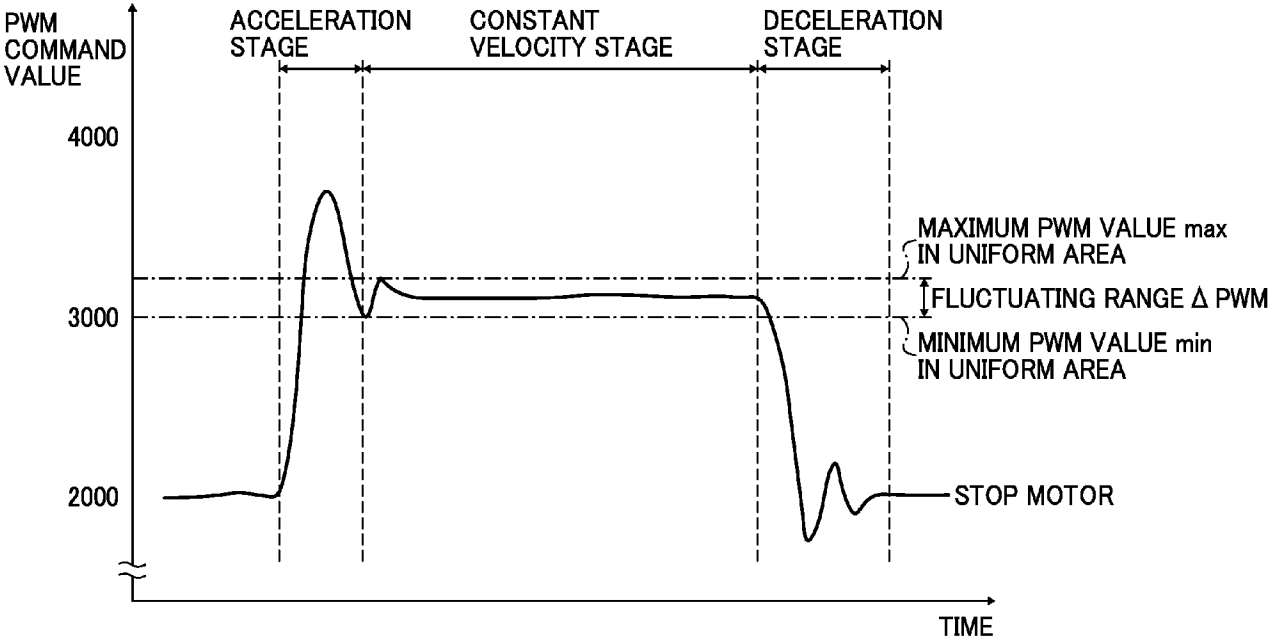
FIG. 12 is a diagram illustrating change of command value for a duty ratio of a PWM value for carriage velocity in forward motion as an embodiment of the present invention.
FIG. 13 is a diagram illustrating relationship between PWM command value and voltage as an embodiment of the present invention.

Next, an example of controlling velocity of the carriage will be described with reference to FIG. 12. FIG. 12 is a diagram illustrating change of command value for a duty ratio of a PWM value for the carriage velocity in one scanning of the carriage (forward motion).

In this embodiment, the driving of the main scanning motor 8 that drives the carriage 5 is controlled by PWM control as described above, and the servo system that includes PI control loop is used for that control. In this system, the carriage velocity is controlled by changing a command value that determines the duty ratio of PWM (hereinafter referred to as "PWM command value").

For example, the PWM command values are assigned as shown in FIG. 13.

Next, an example of controlling the motor velocity by controlling the duty ratio of the PWM will be described below.

First, velocity error (Ve) is calculated by subtracting from the command velocity commanded from outside.

Next, operation amount (the duty ratio of the PWM in this case) is calculated by using Equation 1. In Equation 1, Kp is proportionality control constant and Ki is integration control constant.

$$PWM=Kp\times Ve+Ki\times\int Ve\cdot dt \qquad \text{Equation 1}$$

The control of velocity of the carriage 5 is performed by changing the PWM command value provided to the motor driver 414 in accordance with the calculated value using Equation 1.

It should be noted that, while PI control is used in this embodiment, alternatively it is also possible to use Proportional-Integral-Derivative (PID) control instead.

Figure 14:
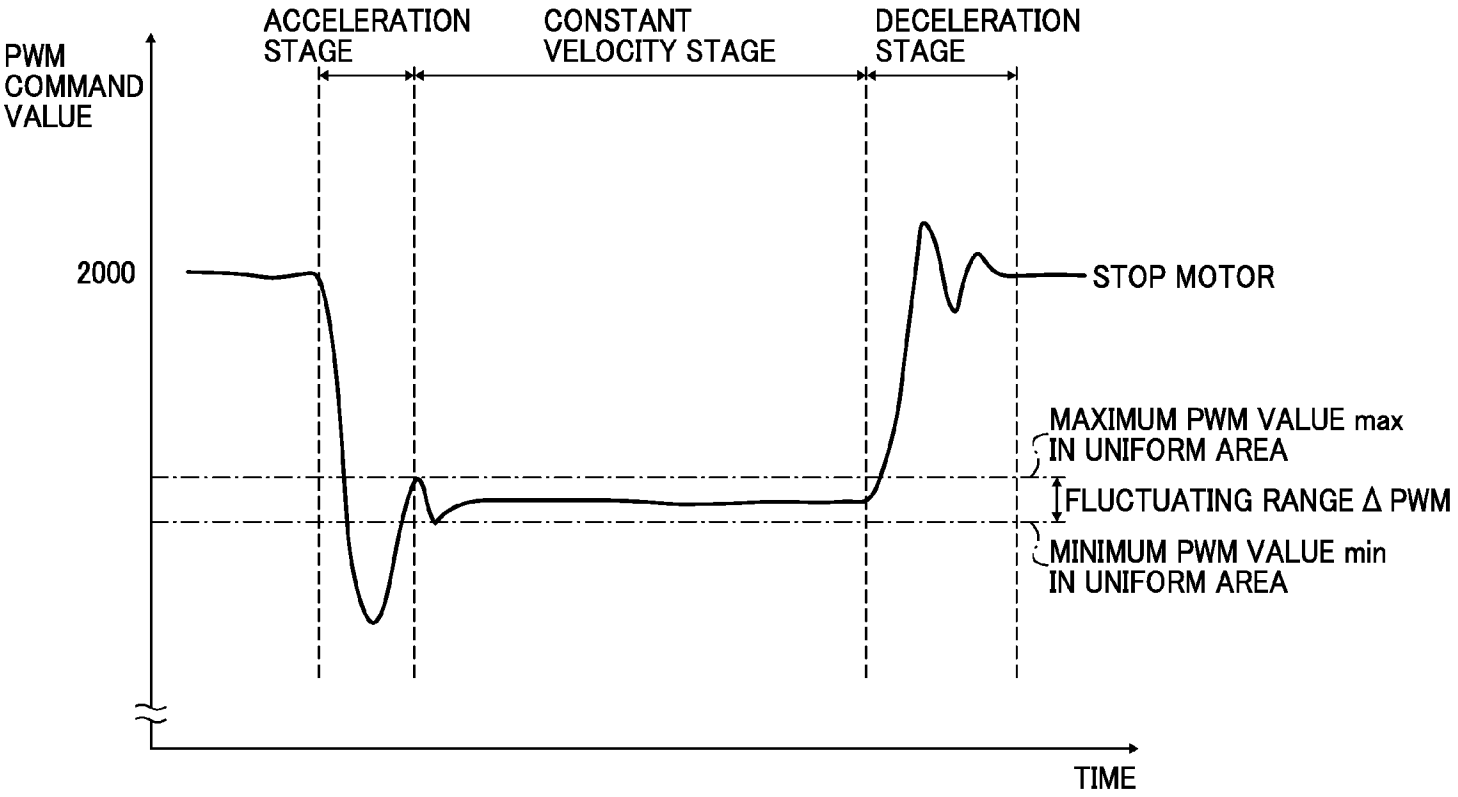
FIG. 14 is a diagram illustrating change of command value for duty ratio of PWM value of carriage velocity in reverse motion as an embodiment of the present invention.

FIG. 14 is a diagram illustrating change of the command value for duty ratio of the PWM value of the carriage velocity in reverse motion.

Figure 15:
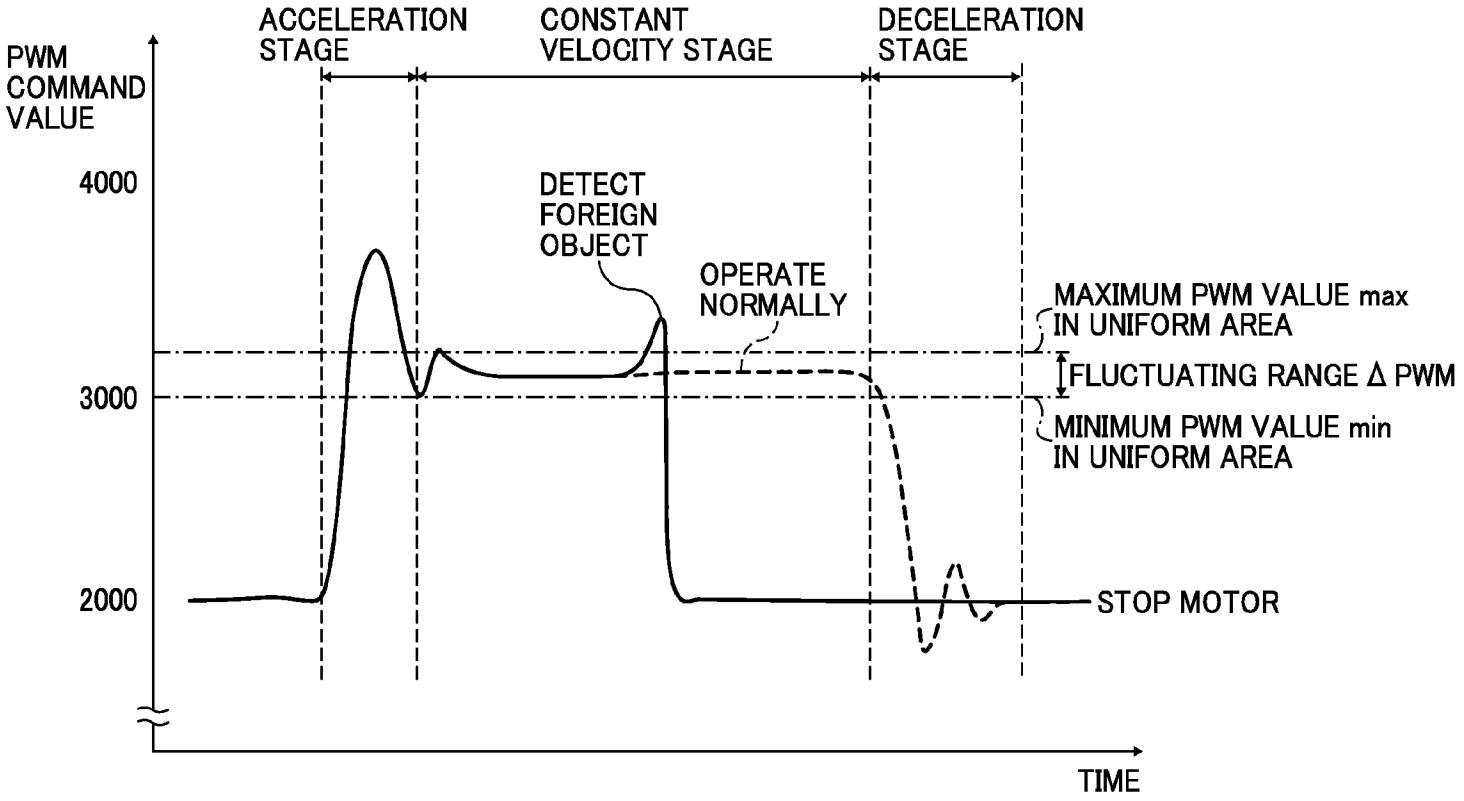
FIG. 15 is a diagram illustrating change of command value for duty ratio of PWM value of the carriage when a foreign object interferes with the carriage while the carriage is moving as an embodiment of the present invention.

Next, an example of controlling detecting a foreign object as the load variation detector will be described with reference to FIG. 15. FIG. 15 is a diagram illustrating change of the command value for the duty ratio of the PWM value of the carriage when a foreign object interferes with the carriage while the carriage is moving.

Here, after storing maximum value Max and minimum value Min for the PWM command value during the uniform control in the constant velocity stage, range between the maximum value Max and the minimum value Min (hereinafter referred to as "fluctuation range") is calculated. Subsequently, the foreign object is detected by comparing the calculated fluctuation range with preset threshold value.

That is, if the carriage 5 intervenes with the foreign object during the uniform motion, the motor controller 408 tries to accelerate the main scanning motor 8 by changing the PWM command value since difference between velocity detected by the encoder sensor 41 (detected position) and target velocity (target position) becomes large.

Next, as the PWM command value changes, the fluctuation range between the maximum value Max and the minimum value Min for the PWM command value becomes large. Consequently, in case of exceeding the preset threshold value of the fluctuation range of the PWM command value, the carriage 5 is stopped after stopping driving the main scanning motor 8 by forcing the PWM command value of the main scanning motor 8 to change to motor stop command (PWM command value 2000 in FIG. 13).

As described above, it can be detected and determined surely and precisely that the carriage intervenes with the foreign object by setting the threshold value for the fluctuation range of the PWM command value.

That is, the PWM command value in the constant velocity stage of the carriage varies due to influence of load etc. and is not always the same command value. Contrarily, the fluctuation range of the PWM command value does not vary even if the load varies, and the PWM command value changes in the way of applying offset to the PWM command value.

For example, in case of increasing the load, the PWM command value increases in the same velocity. Similarly, in case of decreasing the load, the PWM command value decreases in the same velocity. However, the fluctuation range of the PWM command value hardly changes at all.

Consequently, by setting the corresponding threshold value for the fluctuation range of the PWM command value, it is possible to detect the foreign object by using the same threshold value.

Also, velocity in the constant velocity stage varies due to operational difference such as print mode (mode in which speed is given a high priority compared to image quality, or mode in which image quality is given a high priority compared to speed) and at the timing of setting sheet.

In this case, by setting the threshold value for the fluctuation range of the PWM command value, it is possible to detect the foreign object by using the same threshold value.

Furthermore, it is possible to deal with variation of the PWM command value due to a change of surrounding circumstance.

Each process to control the main scanning motor described above is executed by a computer (CPU) reading a program stored in the ROM, etc. The program can be provided storing in storage medium or downloading via a network such as the internet.

In the present invention, it should be noted that material of "sheet" is not limited to paper, "sheet" includes an OHP, cloth, and board, means an object on which ink droplets or other liquid is attachable, and includes things called recording medium and recording paper etc. Also, all of "forming an image", "recording", and "printing" indicate the same meaning.

Also, "image forming apparatus" means an apparatus that forms an image by ejecting liquid on media such as paper, string, fabric, cloth, leather, metal, plastic, glass, wood, and ceramic. "Image forming" means not only adding a meaningful image such as a character and figure to media but also adding a meaningless image such as a pattern to media (simply droplets land on media).

Unless otherwise noted, "ink" is used as a collective term that means not only so-called ink but also all liquids that can form an image such as recording liquid, fixing liquid, and so-called liquid and includes DNA sample, resist, pattern material, and resin for example.

Also, "image" is not limited to two-dimensional image and includes an image added to an object formed in three-dimensional and an image formed by molding a three-dimensional object itself stereoscopically.

In the embodiment described above, the image forming apparatus that uses roll sheet is described. However, that can be applied to an image forming apparatus that uses sheet in the similar way.

Numerous additional modifications and variations are possible in light of the above teachings. It is therefore to be understood that, within the scope of the appended claims, the disclosure of this patent specification may be practiced otherwise than as specifically described herein.

As can be appreciated by those skilled in the computer arts, this invention may be implemented as convenient using a conventional general-purpose digital computer programmed according to the teachings of the present specification. Appropriate software coding can readily be prepared by skilled programmers based on the teachings of the present disclosure, as will be apparent to those skilled in the software arts. The present invention may also be implemented by the preparation of application-specific integrated circuits or by interconnecting an appropriate network of conventional component circuits, as will be readily apparent to those skilled in the relevant art.

What is claimed is:

1. An image forming apparatus, comprising:

a carriage with a recording head mounted therein and configured to move reciprocally back and forth;

a detector configured to detect a position or velocity of the carriage; and a processor configured to control a driving source of the carriage in accordance with the detected position or velocity of the carriage by, controlling the driving source if the processor detects that the carriage has stopped moving, while the carriage is an acceleration stage; and controlling the driving source if the processor detects a load variation of the driving source, while the carriage is in a constant velocity stage.

2. The image forming apparatus according to claim 1, wherein the processor is configured to switch from controlling the driving source upon detecting that the carriage has stopped moving to controlling the driving source upon detecting the load variation of the driving source, when the processor performs a homing operation that determines a home position of the carriage by striking the carriage against another component.

3. The image forming apparatus according to claim 2, wherein the processor is configured to identify a position where the carriage stops as the home position when the processor performs the homing operation.

4. The image forming apparatus according to claim 3, further comprising:

a displaceable component, wherein the processor is configured to detect whether or not the determined home position is correct by detecting displacement of the displaceable component.

5. The image forming apparatus according to claim 1, wherein the processor is configured to switch from controlling the driving source upon detecting that the carriage has stopped moving to controlling the driving source upon detecting the load variation of the driving source, if the carriage moves a target distance.

6. The image forming apparatus according to claim 1, wherein the processor is configured to switch from controlling the driving source upon detecting that the carriage has stopped moving to controlling the driving source upon detecting the load variation of the driving source, when the carriage is located at one end of a recording medium on which the recording head forms an image in carriage moving direction.

7. The image forming apparatus according to claim 1, wherein the processor is configured to switch from controlling the driving source upon detecting that the carriage has stopped moving to controlling the driving source upon detecting the load variation of the driving source, when the carriage reaches a position where the recording head starts forming an image.

8. The image forming apparatus according to claim 1, wherein the processor is configured to switch from controlling the driving source upon detecting that the carriage has stopped moving to controlling the driving source upon detecting the load variation of the driving source, when detected velocity of the carriage exceeds a command velocity.

9. The image forming apparatus according to claim 1, wherein the processor is configured to switch from controlling the driving source upon detecting that the carriage has stopped moving to controlling the driving source upon detecting the load variation of the driving source, when a command velocity commanded to the driving source of the carriage reaches a target velocity.

10. The image forming apparatus of claim 1, wherein the processor is configured to control the driving source by providing a stop command to the driving source.

11. The image forming apparatus of claim 1, wherein the processor is further configured to perform a homing operation to set a home position of the carriage based on the controlling of the driving source in the acceleration stage and the constant velocity stage.

12. The image forming apparatus of claim 11, wherein the processor is further configured to determine whether the set home position of the carriage is correct.

13. The image forming apparatus of claim 12, wherein the processor is configured to determine that the set home position is correct if the processor detects a feeler indicating whether liquid exists in a heat tank of the carriage.

14. The image forming apparatus of claim 13, wherein the processor is configured to report a malfunction if the processor does not detect the feeler.

15. The image forming apparatus of claim 1, wherein the controlling includes applying a signal to the driving source in order for the driving source to stop driving the carriage.

16. The image forming apparatus of claim 15, wherein the signal is a pulse width modulated (PWM) stopping command.

17. The image forming apparatus of claim 16, further comprising:

generating the PWM stopping command by varying a duty cycle of a PWM command prior to applying the PWM command to the driving source.

18. A method of controlling driving of a driving source of a carriage, comprising:

detecting a position or velocity of the carriage in which a recording head is mounted and moves reciprocally back and forth;

controlling the driving source of the carriage in accordance with the detected position or velocity of the carrier by, controlling the driving source if the detecting detects that the carriage has stopped moving, while the carriage is an acceleration stage; and controlling the driving source if the detecting detects a load variation of the driving source, while the carriage is in a constant velocity stage.

19. A non-transitory recording medium including a computer-program product, the computer-program product storing a program that, when executed by a processor, causes the processor to implement a method of controlling a driving of a driving source of a carriage, by:

detecting a position or velocity of the carriage in which a recording head is mounted and moves reciprocally back and forth; and controlling the driving source of the carriage in accordance with the detected position or velocity of the carrier by, controlling the driving source if the detecting detects that the carriage has stopped moving, while the carriage is an acceleration stage; and controlling the driving source if the detecting detects a load variation of the driving source, while the carriage is in a constant velocity stage.

* * * * *